United States Patent [19]

Larsen et al.

[11] 4,332,992

[45] Jun. 1, 1982

[54] AIR FLOW SYSTEM FOR COMBINATION MICROWAVE AND CONVECTION OVEN

[75] Inventors: Wallace L. Larsen, Marion; Eliot R. Duncan, Iowa City, both of Iowa

[73] Assignee: Amana Refrigeration, Inc., Amana, Iowa

[21] Appl. No.: 105,084

[22] Filed: Dec. 19, 1979

[51] Int. Cl.[3] ..... H05B 6/64

[52] U.S. Cl. ..... 219/10.55 R; 219/10.55 B; 219/400; 219/10.55 D; 126/21 A

[58] Field of Search ..... 219/10.55 R, 10.55 B, 219/10.55 E, 10.55 D, 400; 126/21 A, 21 R, 198

[56] References Cited

U.S. PATENT DOCUMENTS

| | | | |
|---|---|---|---|
| 2,860,026 | 11/1958 | Long | 219/10.55 R |
| 3,514,576 | 5/1970 | Hilton et al. | 219/10.55 B |
| 3,569,656 | 3/1971 | White et al. | 219/10.55 B |
| 3,654,417 | 4/1972 | Javes et al. | 219/10.55 R |
| 3,767,884 | 10/1973 | Osepchuk et al. | 219/10.55 D |
| 3,783,219 | 1/1974 | Tateda | 219/10.55 R |
| 4,028,520 | 6/1977 | Torrey | 219/10.55 B |
| 4,096,369 | 6/1978 | Tanaka et al. | 219/10.55 D |
| 4,097,709 | 6/1978 | Bachtold et al. | 219/10.55 R |
| 4,123,643 | 10/1978 | Burke | 219/10.55 R |
| 4,129,769 | 12/1978 | Takagi et al. | 219/10.55 B |
| 4,137,441 | 1/1979 | Bucksbaum | 219/10.55 D |
| 4,162,381 | 7/1979 | Buck | 219/10.55 B |
| 4,184,945 | 1/1980 | Morgan et al. | 219/10.55 B |
| 4,196,330 | 4/1980 | Payne | 219/10.55 B |
| 4,211,909 | 7/1980 | Yoshida et al. | 219/10.55 R |

FOREIGN PATENT DOCUMENTS

| | | | |
|---|---|---|---|
| 49-34440 | 3/1974 | Japan | 219/10.55 R |
| 51-82042 | 6/1976 | Japan | 219/10.55 B |
| 54-102640 | 8/1979 | Japan | 219/10.55 B |

*Primary Examiner*—B. A. Reynolds
*Assistant Examiner*—Philip H. Leung
*Attorney, Agent, or Firm*—Robert W. Hoke, II

[57] ABSTRACT

An air flow system for a combination microwave and electric convection oven wherein a single motor drives two fans to generate a movement of air in an oven cavity and a movement of air in an electrical component compartment. The fan moving the air in the electrical component compartment is positioned between the fan moving the air in the oven cavity and the motor to act as a thermal barrier and to protect the motor from the heated air in the oven cavity. A portion of the air in the electrical component compartment may be diverted to the oven cavity and subsequently exhausted from the oven. Simultaneously, an electrical heater may be de-energized with the result that the air in the oven cavity is heated by resistive losses from components in the electrical component compartment. By combining this diverted air flow with a minimum of microwave energy, many types of foods may be effectively dehydrated in a substantially shorter than normal period of time.

10 Claims, 10 Drawing Figures

69
19
72
29
21
8
11b
11a
18
5
92
15
15
9
13
2
2
6
7

AIR FLOW SYSTEM FOR COMBINATION MICROWAVE AND CONVECTION OVEN

BACKGROUND OF THE INVENTION

The invention relates to combination electric and microwave ovens generally and more particularly to an air flow system to enhance the application of thermal energy or microwave energy or both forms of energy in a common oven cavity.

Combination ovens combining the capability of microwave energy with the capability of radiant energy or circulated hot air are well known in the art. Numerous forms of these ovens have appeared on the market and are available to the consumer at the retail level. In addition, several United States patents have issued disclosing various aspects of these ovens. For example, U.S. Pat. No. 3,514,576 discloses a combination oven that simultaneously exposes food to microwave energy and heated air. U.S. Pat. No. 3,569,656 discloses a control concept for controlling the application of infrared radiation and microwave radiation in an oven. U.S. Pat. No. 4,129,769 discloses a timer arrangement for a combination oven. U.S. Pat. Nos. 4,028,520, 4,096,369, and 4,097,709 each disclose air flow systems for such ovens.

It is generally accepted that circulating the air heated by an electric resistance heater will ovenbrown food faster than air naturally convected by differences in temperature caused by the heater. The improved heat transfer associated with forced convection ovens results in savings in time and energy. Additional savings are realized where the heat is evenly distributed.

Even heat distribution and improved heat transfer permit the circulated hot air or convection oven user to reduce the oven temperature without unduly lengthening the cooking time. In fact, most foods cook at lower temperatures and for less time than in a predominately radiant-heat-transfer oven. This, in turn, keeps the oven walls cleaner by reducing the likelihood of grease splatter from the cooking food. And, since the food surface is cooked faster, the food is more moist and more flavorful because the natural juices and flavors are sealed inside very quickly.

One difficulty with prior attempts to combine cooking with microwaves with electric resistance heat, whether circulated or not, has been the inability to do so using normal household voltage and current. This is primarily a result of the power requirements normally associated with portable microwave and electric ovens that operate from 110 to 120 volts. Both are generally designed to draw approximately 15 amperes of current. To draw much less than 15 amperes would substantially impair the smaller ovens' ability to cook quickly. To combine them and apply them simultaneously in one cooking operation, then, would require approximately 30 amperes of current. This is not typically or normally available from a household outlet.

One solution employed in the past has been to manually apply microwave energy and radiant energy sequentially to the food. Numerous microwave ovens have appeared on the market equipped with "browning" elements or sheathed resistive elements to brown food. U.S. Pat. No. 4,129,769, referred to earlier, discloses a timer arrangement for such a device. The difficulty with manually switching the two forms of energy is that they are not truly combined in one cooking operation. In the microwave mode, the browning element does not absorb energy to get hot enough to contribute significantly to the cooking process. In the electric mode, the microwave generator or magnetron does not function at all. Hence, the cooking process is confined to two steps, cooking with microwaves followed by thermal browning or vice versa.

Another possible solution would be to cut the power requirements of the microwave oven and the electric oven to limit their total current requirements to approximately 15 amperes when they are operated simultaneously. To do so, though, would greatly increase the time required to cook with microwave energy alone. This would, of course, negate the single most important reason for cooking with microwaves-speed.

Hence, commercial products incorporating truly dual microwave and electric cooking capabilities have been limited to specially provided, single location 220–240 volt sources when cooking with both modes simultaneously has been desired. This is the same power source used by traditional free-standing and built-in ranges, and the truly dual mode ovens have been only so built as distinguished from countertop or portable ranges or ovens that operate off ordinary wall outlets.

In co-pending U.S. Patent Application Ser. No. 049,454, now abandoned hereby incorporated by reference, filed June 18, 1979, in the names of Buddy J. Austin and John R. Copping and assigned to the same assignee as the present invention, there is disclosed an electrical circuit for a truly dual microwave and electric oven that uses normal household voltage and current to cook by dielectric heating from microwaves and thermal heating from an electric resistance heater. As disclosed in the Austin et al. application, circulation of the air heated by an electric heater past the food further reduces the time and energy required to cook the food. By carefully controlling and utilizing that air and the air used to cool the electrical components of the oven, yet further savings are realized, and an even superior food products results.

SUMMARY OF THE INVENTION

According to the invention, there is provided an improved air flow system for a portable convection and microwave oven operating from normal household current and cooking food with results comparable to that achieved in free-standing and built-in ranges and in a substantially shorter period of time.

The primary object of the invention is to provide an improved air flow system for a portable, combination microwave and electric resistance oven that circulates the hot air generated by the heater past the food.

Another object of the invention is to maximize the temperature of the hot air passed by the food for any temperature setting chosen for the electrical heater of the combination oven.

A further object is to minimize the total energy consumed by the combination microwave and electric convection oven during the cooking process.

It is another object of the invention to adapt the air system so that the oven can cook with microwaves alone, circulated hot air alone, or both forms of energy simultaneously without sacrificing the perceived advantages generally associated with cooking with each of these methods individually.

A further object is to circulate the air evenly around and past the food while minimizing the condensation of cooking vapors and water vapor on the walls and on the door of the oven.

Another object of the invention is to cook the food and to cool the microwave generator and other electrical and mechanical components when the electrical heater and the microwave generator are utilized in a single cooking operation.

A further object is to utilize the air heated by the electrical components without the aid of the electrical heater to further reduce the total amount of energy consumed.

It is another object of the invention to maintain the air pressure inside the oven cavity at or slightly above atmospheric pressure to increase the cooking speed and to prevent the introduction of cooling air around the door seal.

A further object is to cool the air leaving the oven cavity before it exits from the oven.

It is still another object of the invention to provide a unique way of insulating from the oven cavity heat the motor powering the fans that circulate the air through the system.

Other objects and advantages of this invention will become apparent from the following description, the accompanying drawings and the appended claims.

DESCRIPTION OF THE PREFERRED EMBODIMENT

Figure 1:
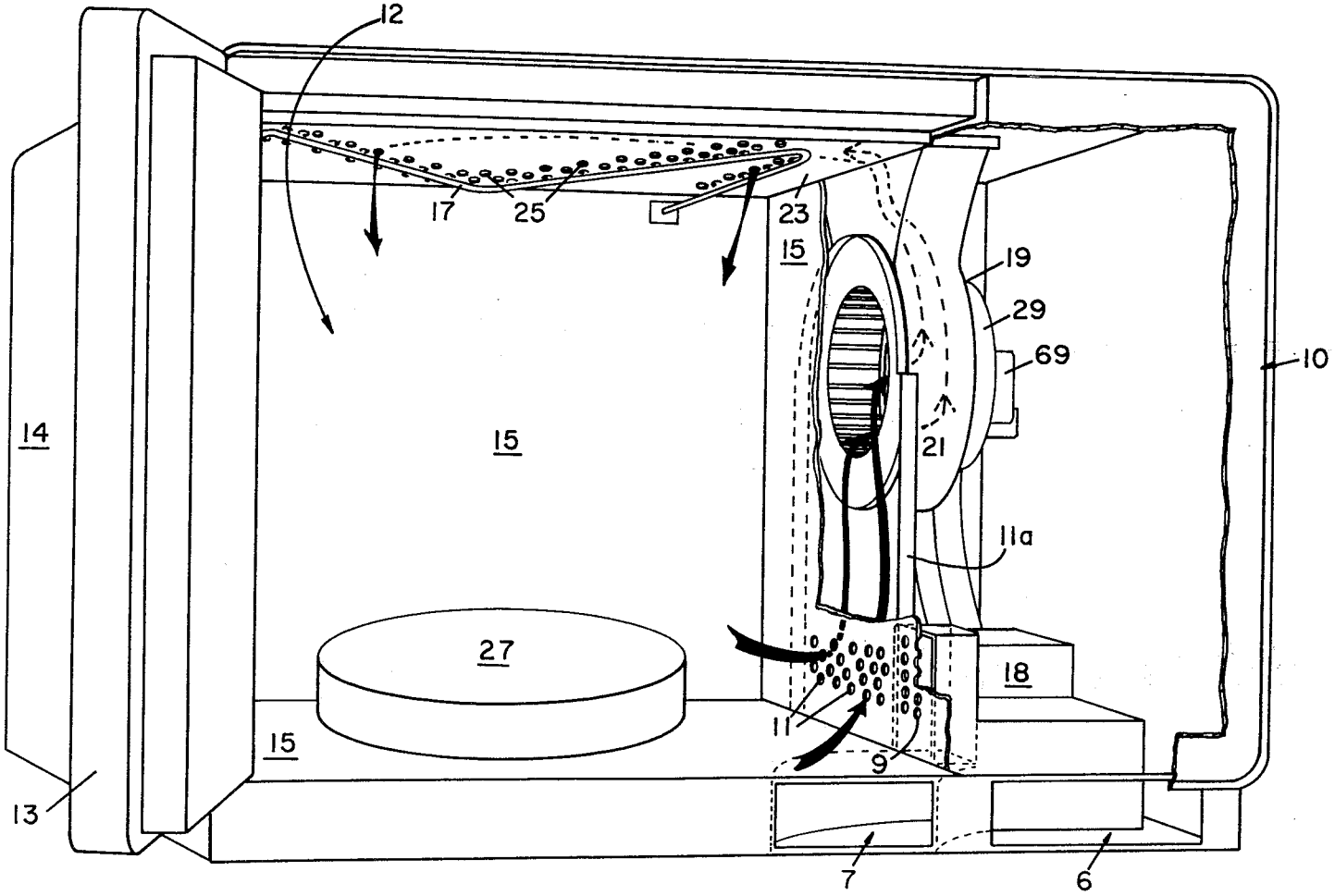
FIG. 1 is a front perspective view of a combination electric convection and microwave oven with portions broken away to illustrate a first air circulation path in the oven cavity.
Figure 7:
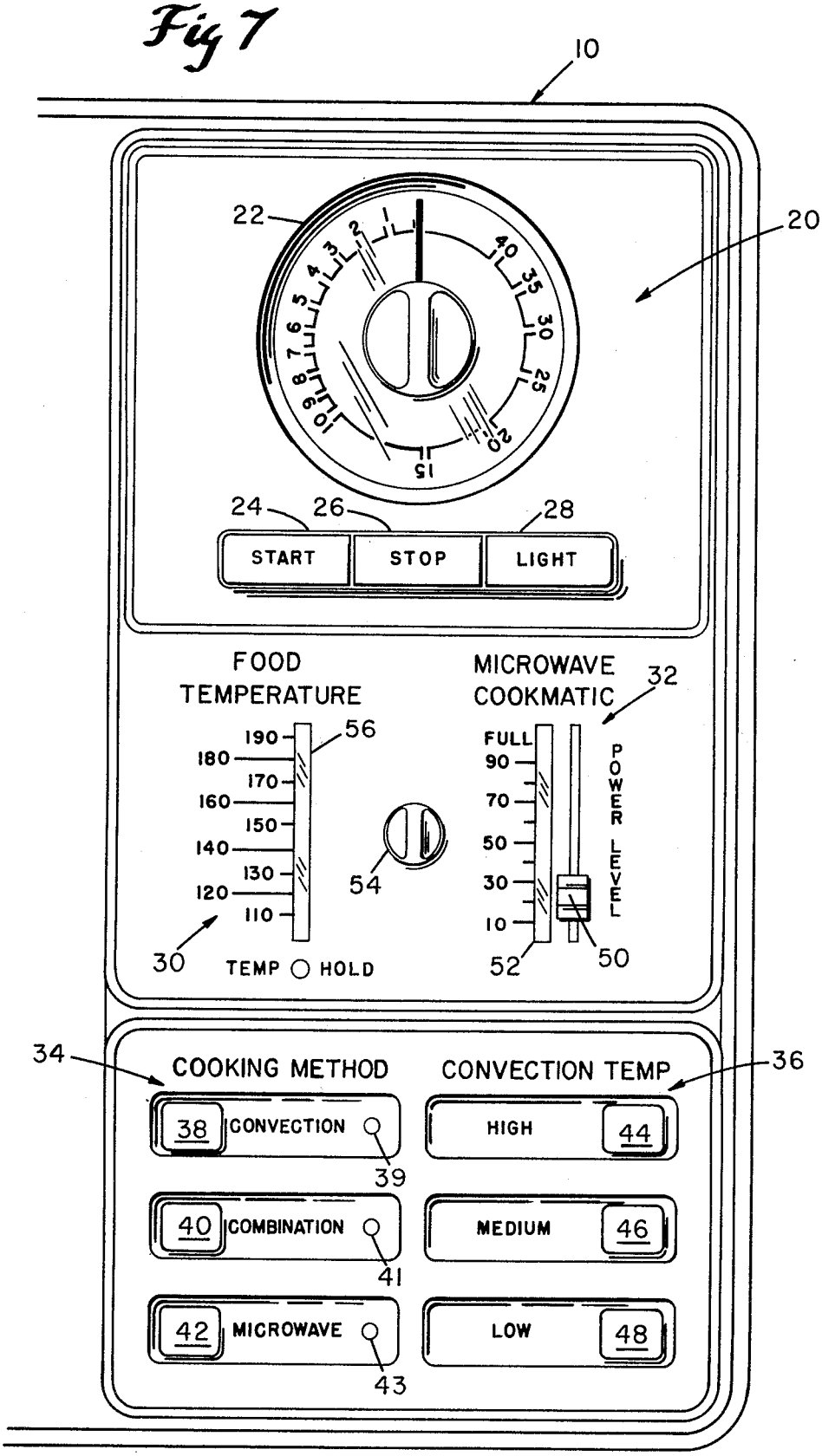
FIG. 7 is a front view of the control panel that was largely broken out of FIGS. 1 and 3.

Referring to FIG. 1 and FIG. 7, a combination electric convection and microwave oven 10 is shown having an oven cavity 12, an electrical resistance heater 17, a magnetron 18, a dual-end blower 19, and a control panel 20 surrounded by a cabinet 14. Control panel 20 is comprised of an oven cycle timer 22, "START", "STOP", and "LIGHT" push buttons numbered 24, 26, and 28, respectively, temperature sensing probe controls 30, variable power controls 32 for controlling the ratio of microwave energy to thermal energy applied to the oven cavity 12 when in the "COMBINATION" and "MICROWAVE" modes, cooking method controls 34, and convection heater temperature level controls 36.

Cooking method controls 34 control the operation of the oven in three different modes or types of cooking sequences. "CONVECTION" push button 38 allows the oven to operate as a convection oven only; no microwave energy is applied during this mode of operation. "COMBINATION" push button 40 applies alternately thermal heat and microwave radiation to the oven cavity 12 in a predetermined ratio as set by variable power controls 32. "MICROWAVE" push button 42, when actuated, activates the magnetron 18 but not the convection heater 17 to provide microwave energy to the cavity 12.

If the operator chooses to operate the oven in the convection mode by pressing "CONVECTION" push button 38, the convection heater 17 will operate at one of three temperature levels as selected by temperature controls 36. Push button 44 operates heater 17 at the highest average temperature setting. Push button 46 is a somewhat lower or "MEDIUM" temperature setting. Push button 48 is a "LOW" temperature setting for the convection mode, and as will be described more fully below, convection heater 17 is not electrically powered in the "LOW" setting. The air is instead heated by other means that will be further discussed.

If the "COMBINATION" push button 40 is selected, the convection heater 17 will operate at one of three temperature levels selected by controls 36 in sequence with the magnetron 18 as determined by the variable power controls 32. Variable power controls 32 effectively select the ratio of the microwave power to convection power applied to the oven cavity 12 on the average for a cooking cycle set by timer 22. A sliding switch 50 is used in conjunction with a visual display 52 to show the microwave-to-convection ratio selected.

If a temperature probe is used, its operation is controlled by controls 30. Selector switch 54 is rotated to select the final food temperature desired. The temperature chosen is displayed by visual display 56. The construction and operation of a suitable temperature probe is disclosed in U.S. patent application Ser. No. 903,447, now abandoned assigned to the same assignee as the present invention and hereby incorporated by reference. A detailed description of the probe is omitted for the sake of brevity.

Figure 8:
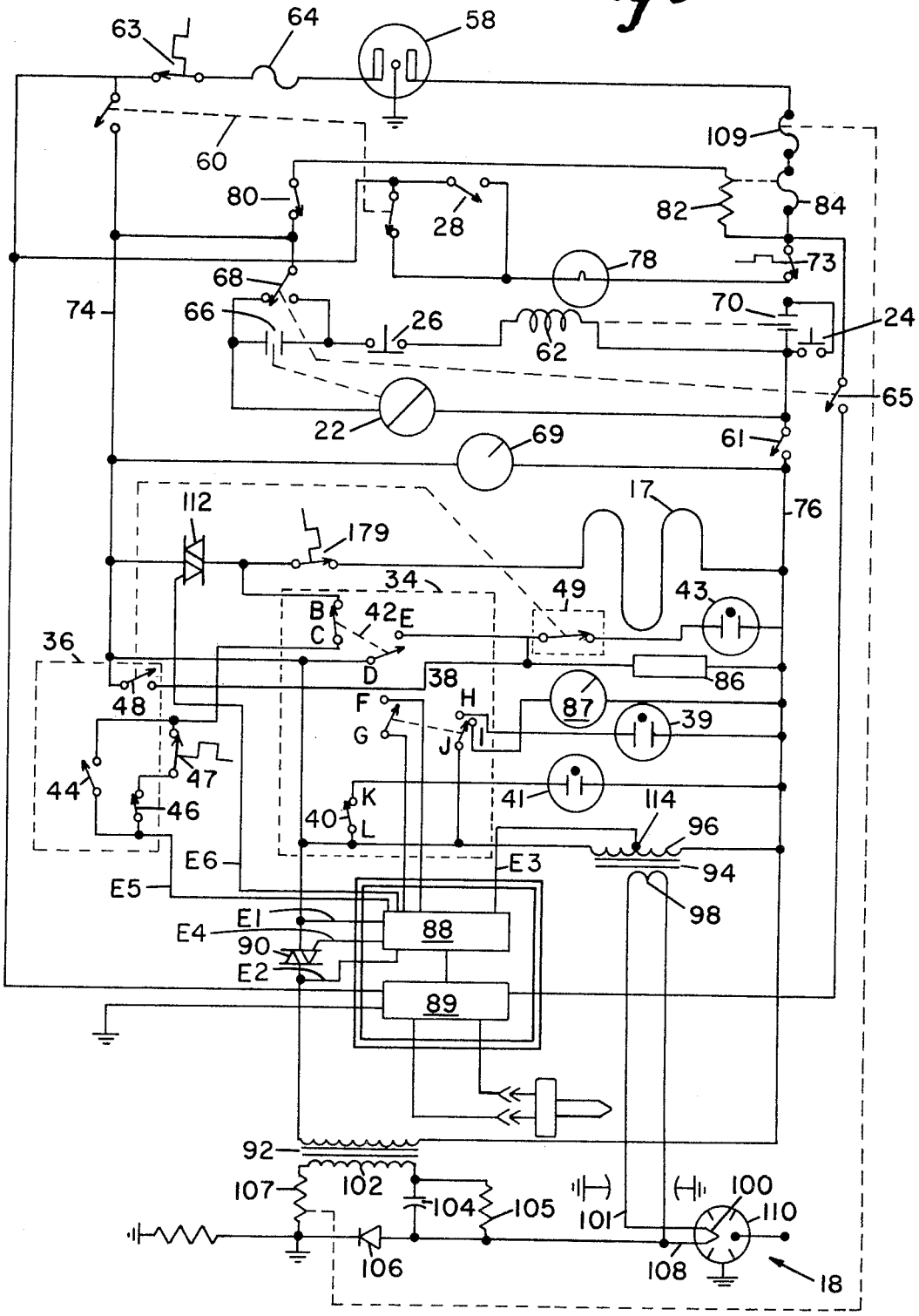
FIG. 8 is an electrical schematic for controlling the operation of the oven of FIGS. 1 through 7.

Referring now to FIG. 8, an electrical schematic is shown for controlling the operation of the oven 10. It is in the combination mode as shown. Power is supplied from a conventional, grounded, three-prong plug 58 that is in turn connected to a typical 110–120 volt, 60 Hz., household circuit. Closing door 13 closes interlock switches 60 and 61. When momentary start switch 24 is depressed, current is applied to relay coil 62 through fuse 64, thermal switch 63, and timer contacts 66 when time is set on timer 22 and switch 68 is closed as shown. Probe switch 68 is closed when a probe, not shown, is removed from a suitable jack and plug assembly, not shown, such as that disclosed in U.S. Applications Ser. Nos. 903,447 and 049,454 already incorporated by reference.

Once powered, relay coil 62 closes contacts 70 to provide current to power conductor 76 through magnetron thermal switch 73. Power conductors 74 and 76 will remain energized until momentary stop switch 26 is depressed or current is otherwise interrupted.

Cavity light 78 will be lit by interlock switch 60 any time door 13 is open. It may also be lit by depressing light switch 28 located on control panel 10 as shown in FIG. 7.

In addition to safety interlock switches 60 and 61, the circuit is provided with a monitor switch 80 to further prevent operation of magnetron 18 when door 13 is open and switch 60 is defeated. Monitor switch 80 is normally open when door 13 is closed and closed when door 13 is open. If door 13 is opened and interlock 60 fails to open, resistor 82 will heat fusible link 84 causing it to break down and open the circuit.

Once activated, power conductor 74 supplies current to blower motor 69 that operates blower 19 and to filament transformer 94. Filament transformer 94 has a primary winding 96 connected across power conductors 74 and 76 and a secondary winding 98 connected to supply the magnetron filament 100. It is necessary to provide the separate filament transformer 94 to maintain the filament 100 constantly energized during those periods when the power transformer 92 is de-energized in either of the cooking modes utilizing microwave energy. With the relatively short one or two second timing period associated with a solid-state, duty-cycle power-level control such as that in circuitry 88, unsatisfactory operation of the magnetron 18 would result if its filament supply were interrupted at such a rate. Feed-through filter capacitor 101 prevents microwave frequency energy from disturbing the operation of filament transformer 94. Resistor 107 protects transformer 92 by heating fusible link 109 causing it to break down if exposed to excessive current. A 13 volt AC tap 114 on the primary winding 96 powers triac triggering circuitry 88. The tap 114 operates in autotransformer fashion.

Figure 9:
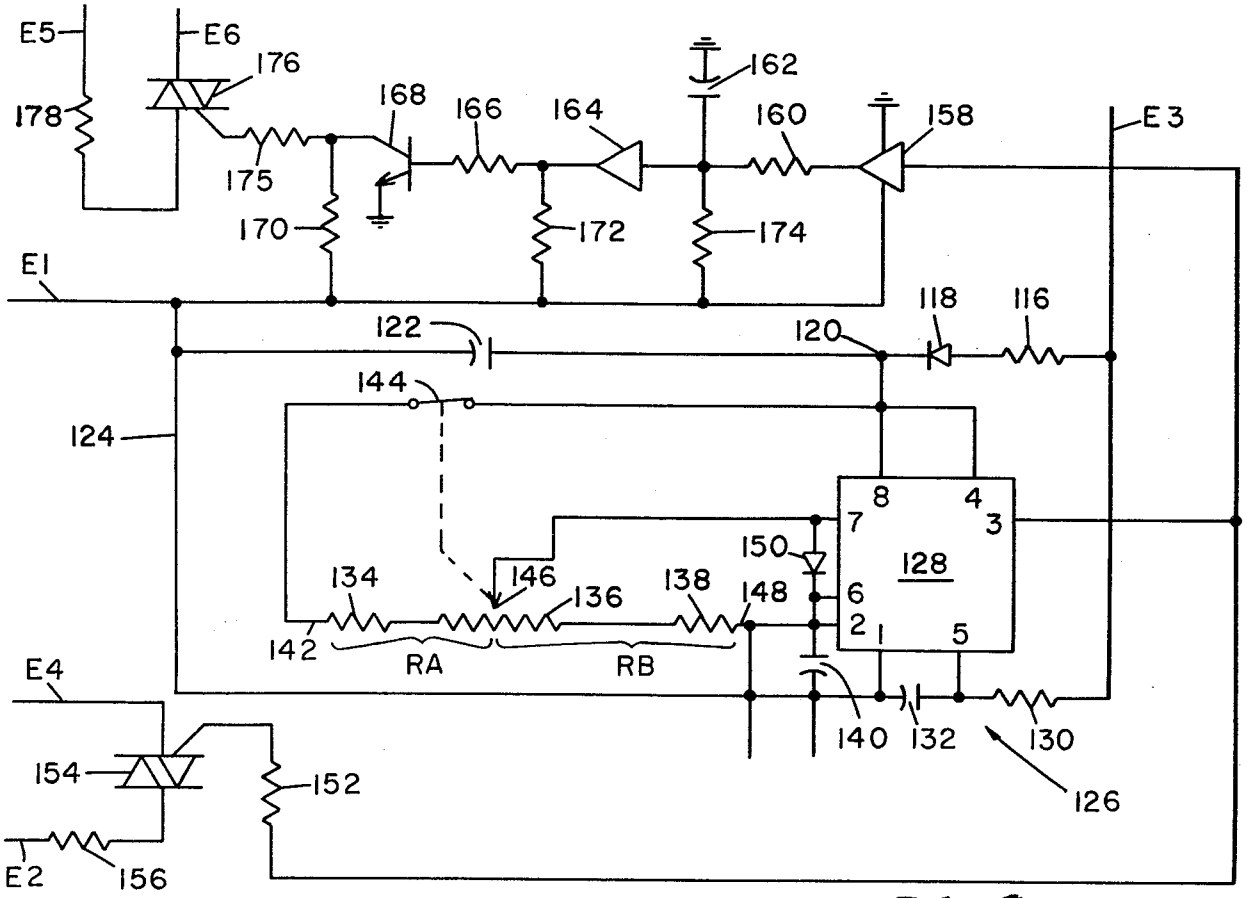
FIG. 9 is a detailed schematic of the triac triggering circuitry shown in FIG. 8.

As shown in FIG. 8, and in greater detail in FIG. 9, the triggering of triacs 90 and 112 is controlled by circuitry 88. Circuitry 88 together with triac 90 and/or triac 112 is a preferred variable duty-cycle, solid-state power-level control. A simple power supply comprising a current limiting resistor 116 and series rectifier diode 118 supplies approximately 13 volts DC to a positive DC supply terminal 120 from lead E3. A filter capacitor 122 is connected between DC supply terminal 120 and a circuit reference conductor 124 which is also connected to power conductor 74 by lead E1. Thus, reference conductor 124 for triac triggering circuitry 88 is not connected to "ground" but rather is ultimately connected to the "live" power source terminal of plug 58.

The variable duty cycle square wave oscillator 126 is an astable multivibrator built around a "555" IC timer 128. Connections shown for timer 128 are those for an eight pin, dual inline IC package.

The positive DC supply pin 8 of IC timer 128 is connected to supply terminal 120. Ground pin 1 is connected to circuit reference conductor 124. Pin 4 is tied to pin 8 since the function provided by pin 4 is not utilized in this circuit. Pin 5 is powered by resistor 130 and capacitor 132 to synchronize the output of pin 3 with the line voltage.

A timing resistor 134, a user-variable potentiometer 136 shown in FIG. 7 as variable power controls 32, a timing resistor 138, and a timing capacitor 140 are serially connected and together determine the period and duty cycle of oscillator 126. The free terminal 142 of timing resistor 134 is connected through a normally closed contact of switch 144 to terminal 120. Switch 144 is ganged with movable potentiometer contact 146 which is operated by slide 50 as shown in FIG. 7 and, when open, disables timer 128 to provide constant "on", full microwave power. Free terminal 148 of timing resistor 138 is connected to sensing pins 6 and 2 of IC timer 128 and to capacitor 140. The lower terminal of capacitor 140 is connected to reference conductor 134. To complete the timer circuit, movable contact 146 is connected to the "discharge" pin 7 of IC timer 128, and a current bypass diode 150 is connected between movable potentiometer contact 146 and terminal 148 of resistor 138.

As an aid to understanding the operation of oscillator 126, timing resistor 134 and that portion of potentiometer 136 which is to the left of contact 146 together are designated $R_A$; timing resistor 138 and that portion of potentiometer 136 which is to the right of contact 146 together are designated as $R_B$.

In operation, the "555" IC timer 128, through its pins 2 and 6, senses the voltage on the timing capacitor 140. Depending upon the voltage so sensed, the "555" IC either permits "discharge" pin 7 to float or internally grounds pin 7. When pin 7 is floating, capacitor 140 charges through resistance $R_A$ and the bypass diode 150 toward the potential at the positive DC supply terminal 120. When the voltage on the capacitor 140 reaches two-thirds of the DC supply voltage, pin 7 goes to ground and the capacitor 140 discharges through the resistance $R_B$. To provide an output at the same time, the internal arrangement of the IC is such that the voltage at the output pin 3 goes up and down in synchronism with "discharge" pin 7. As a result, the $R_AC$ time constant determines the length of the "on" period and the $R_BC$ time constant determines the length of the "off" period. By moving the position of the potentiometer movable contact 146, the user varies the percentage of "on" time to "off" time.

When the output of pin 3 goes up or is "on", it gates trigger triac 154 through resistor 152. This causes triac 154 to conduct and gate microwave triac 90 from lead E2 through current limiting resistor 156. Once conductive, microwave triac 90 provides power to power transformer 92. A high voltage secondary winding 102 of power transformer 92 is connected to energize magnetron 18 through a half-wave voltage doubler comprising a series capacitor 104, a bleeder resistor 105, a rectifying diode 106 connected across the magnetron anode and cathode terminals 108 and 110, respectively, and oppositely poled with respect thereto. Energy generated by the magnetron 18 may be coupled to the cavity 12 in conventional fashion.

The output of pin 3 also controls the operation of convection heater 17 through a time delay circuit consisting of a buffer 158, a timing resistor 160, a timing capacitor 162, a bias resistor 174, a buffer 164, a base resistor 166, a bias resistor 172, and a transistor inverter 168. When pin 3 goes up, it provides a voltage at the input to buffer 164 which rises as a function of the resistance and the capacitive of resistor 160 and capacitor 162, respectively. At two-thirds of the pin 3 voltage, buffer 164 conducts, providing power to the base of transistor inverter 168. Once powered, inverter 168 pulls to ground and removes the gating signal from trigger triac 176. This turns "off" triac 176, which in turn, turns off convection triac 112 thereby cutting power to convection heater 17.

When the output of pin 3 is low, transistor inverter 168 does not conduct, and triac 176 is gated by a signal from lead E1 through load resistor 170 and current limiting resistor 175. In this mode, trigger triac 176 drives convection triac 112 through current limiting resistor 178 and temperature controls 36 to power convection heater 17 through thermal switch 179. Magnetron 18 is not powered in this mode since microwave triac 90 is not triggered by trigger triac 154. Thus, oven 10 can effectively apply microwave and conventional thermal energy to oven cavity 12 in the combination mode to cook with both forms of energy simultaneously without exceeding the limits of normal household current. This effect is enhanced when heater 17 is of the sheath-type contruction as distinguished from an open wire construction due to the higher thermal inertial qualities of the sheath-type constructed electrical resistive elements. The higher thermal inertial qualities of conventional sheathed electrical heating elements is well known and further discussion has been eliminated for the sake of brevity.

The time delay provided by resistor 160 and capacitor 162 in combination with buffer 164 preferably prevents convection heater 17 and magnetron 18 from both drawing power at the instant the output pin 3 switches from "on" to "off" or vice versa approximately every second. When pin 3 goes low or is "off", convection heater 17 is not provided with power until magnetron 18 stops oscillating. Thus, the circuit is protected from the current surge that might otherwise result from having both heater 17 and magnetron 18 drawing substantial amounts of power at the same instant.

As noted above, convection triac 112 is gated by a signal through temperature controls 36 when pin 3 goes low. The three switches making up controls 36 correspond to the three push buttons shown in FIG. 7. When switch 44 is closed, triac 112 is gated whenever pin 3 is low. When switch 46 is closed, as shown, thermal switch 47 intermittently gates triac 112. This intermittent operation in turn intermittently powers heater 17 to result in a lower or "MEDIUM" temperature setting. By pressing button 48, convection heater 17 is effectively removed from the circuit to provide the lowest temperature setting as described earlier. Switches 44, 46, and 48 are ganged in conventional fashion so that the pressing, and hence, closing of one causes the opening of the other two switches.

As noted earlier, triggering circuitry 88 is constantly energized by tap 114 off filament transformer 94. It may be effectively disabled by opening switch 144 to provide constant "on", full microwave power. Similarly, it may be effectively shorted by closing contacts F and G in mode cooking method controls 34 to provide constant "off", full convection heater power.

Cooking method controls 34 are used to choose between cooking with microwaves alone, hot air alone, or some combination of the two. Push buttons 38, 40, and 42, shown in FIG. 7, are mechanically linked to contacts B through L, shown in FIG. 8, in conventional fashion to selectively power the heater 17 and the power transformer 92, to circulate the hot air, to cool the magnetron, and to operate the related components and accessories. Buttons 38, 40, and 42 are ganged similarly to buttons 44, 46, 48 so that pressing one causes cancellation of the effect of pressing a different one earlier. For example, in FIG. 8, contacts B–L of controls 34 are shown with "COMBINATION" button 40 last depressed. Pressing button 38 or 42 would nullify the effect of earlier pressing button 40 by opening contacts K and L of switch 40 and opening contacts B and C and closing contacts D and E of switch 42 or closing contacts F and G, and H and J of switch 38.

As shown in FIG. 8, contacts B through L of controls 34 are positioned to operate the oven in the combination mode as a result of pressing "COMBINATION" push button 40. Contacts B and C provide the signal used by trigger triac 176 to gate convection triac 112 in the manner already described. Contacts I and J energize motor 87 which, in turn, drives a conventional-type microwave energy distribution system, not shown, such as a mode stirrer or a rotating antenna feed system, for example. And contacts K and L energize combination light 41 also shown in FIG. 7.

With "COMBINATION" button 40 of controls 34 and either "MEDIUM" temperature button 46 or "HIGH" temperature button 44 of controls 36 pushed, the air flow diverter 8 will be open and the first air circulation path of FIG. 1 is established. Then, with the door 13 closed and power conductors 74 and 76 properly energized by depression of start switch 24, the oven operates to cook a food with microwaves and circulating hot air simultaneously. As shown in FIG. 1, air is drawn out of oven cavity 12, through cavity wall openings 11, and into duct **11*a* leading to the inlet of convection blower wheel 21 of blower 19. From there, it is exhausted into an air duct 23 mounted on the interior of the top wall of cavity 12 from which it exits through a plurality of holes 25 in the air duct 23 in close proximity to the heater 17. By concentrating the holes 25 in the area of heater 17, the heat transfer from the heater 17 to the air rushing through the holes 25 and subsequently past a food 27** to be cooked in the oven is maximized.

Figure 2:
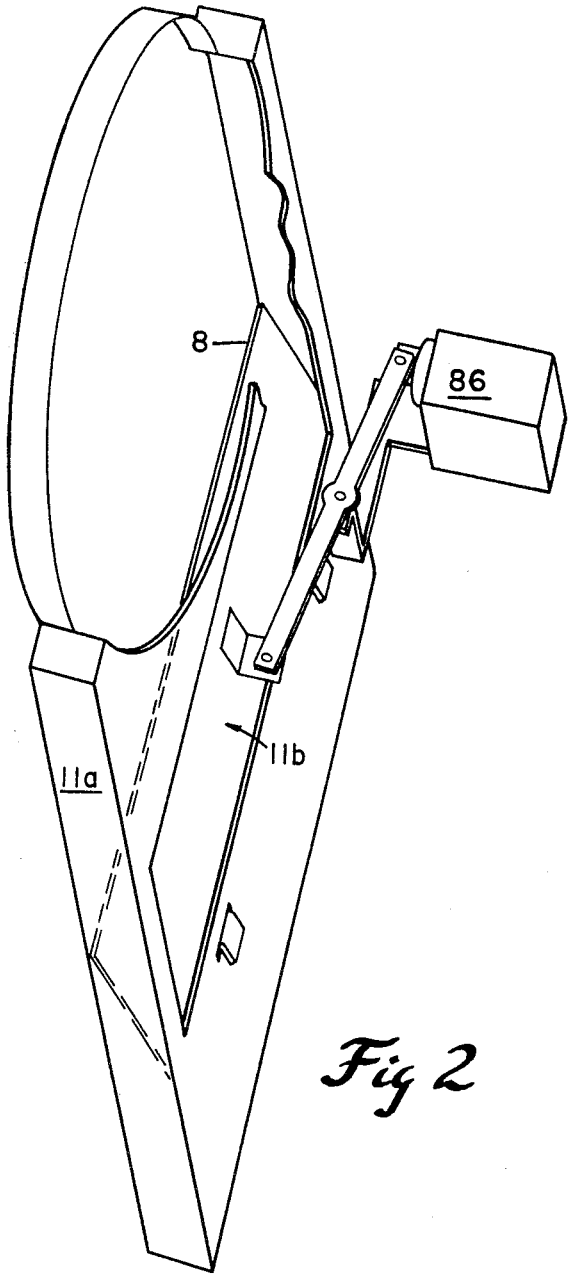
FIG. 2 is an elevated, perspective view of the movable air flow diverter and duct work assembly of FIG. 1 that connects the oven cavity to the inlet of the convection blower wheel. The diverter is shown in the closed position to divert the cavity air out of the oven as shown in FIG. 3.
Figure 3:
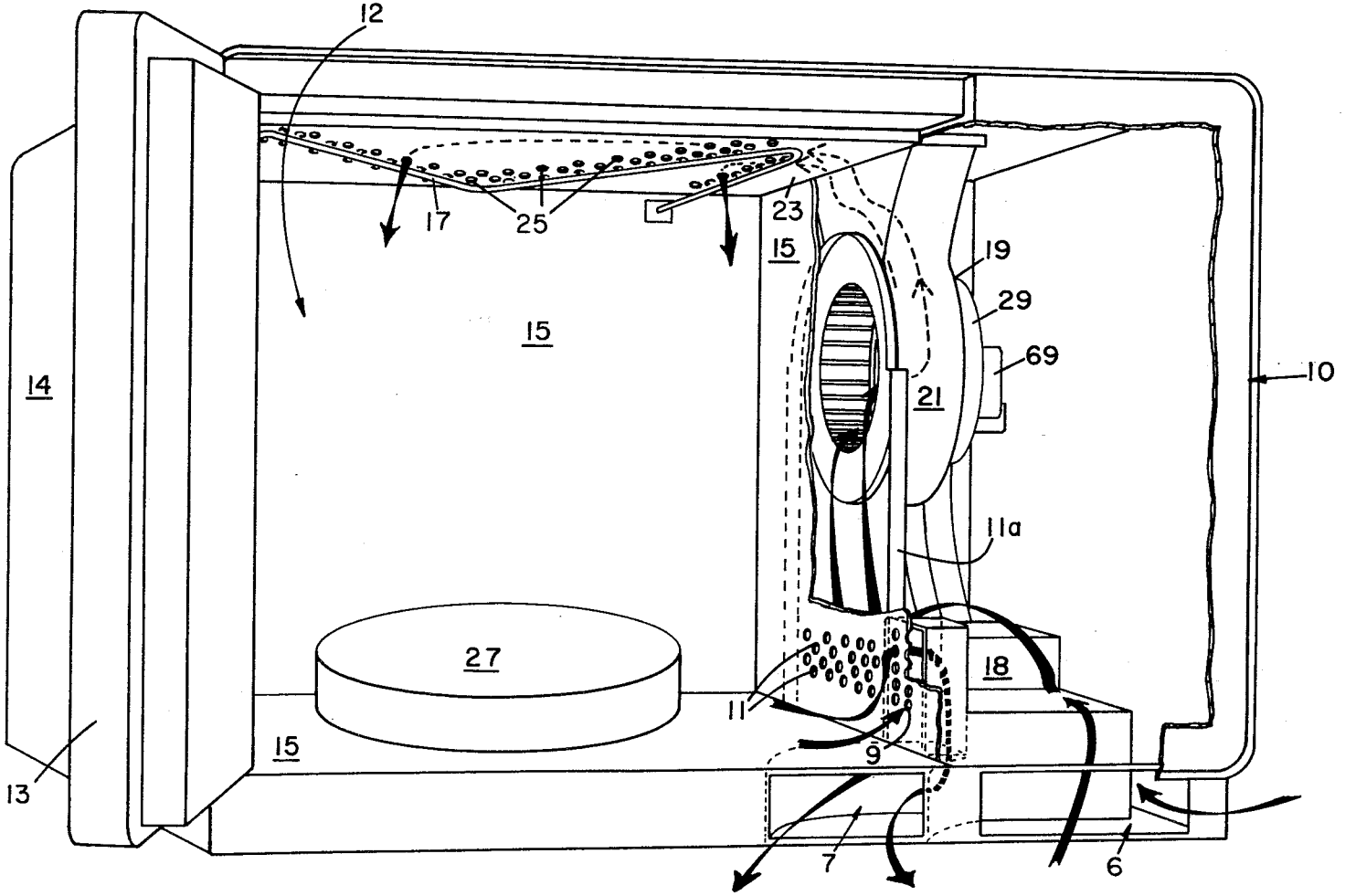
FIG. 3 is a front perspective view of the combination oven of FIG. 1 with the diverter closed to illustrate a second air circulation path.
Figure 4:
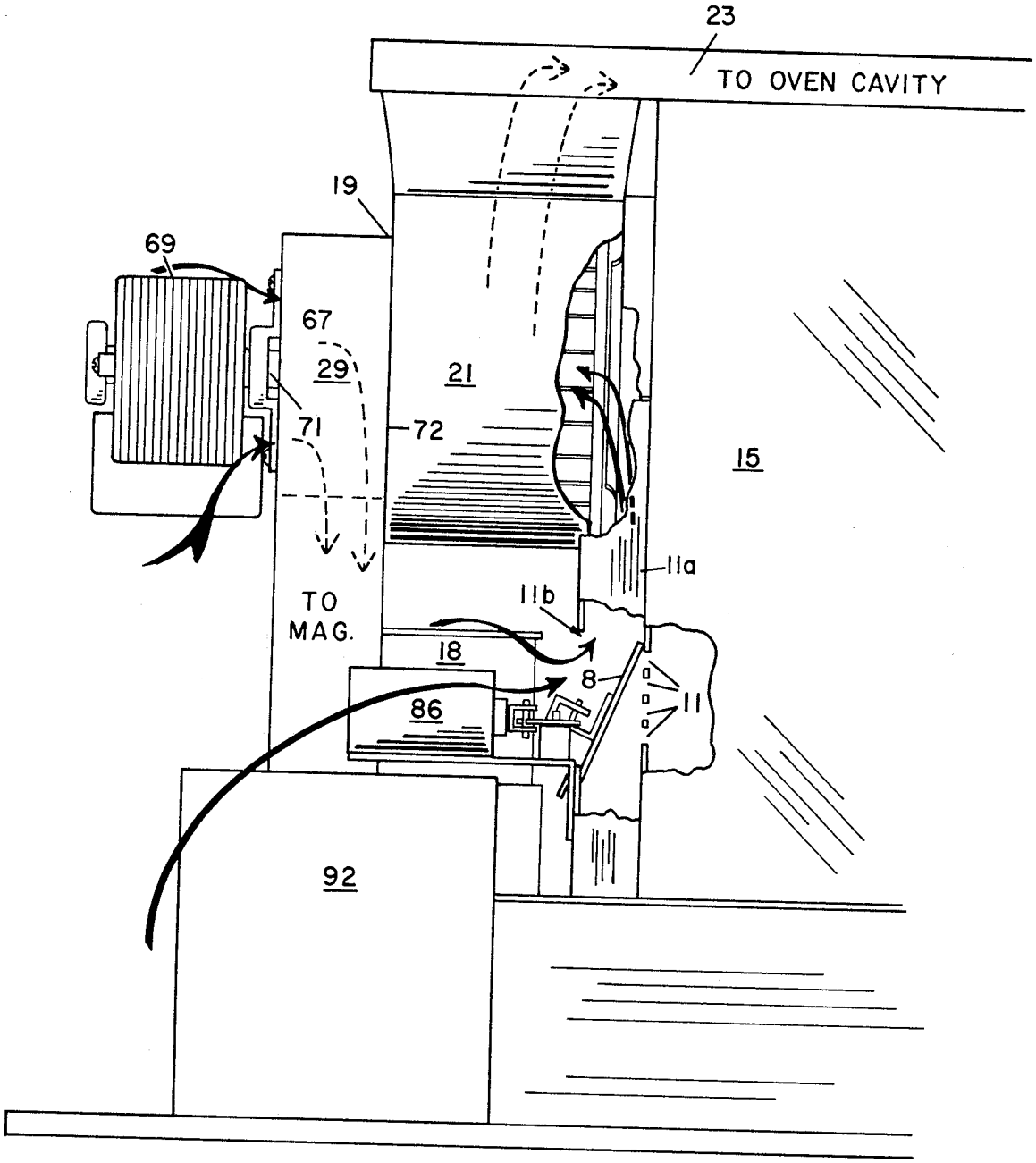
FIG. 4 is a rear view of the oven of FIGS. 1 and 3 with the outer cover removed and portions broken away to further illustrate the air flow when the diverter is closed as shown in FIG. 2 and FIG. 3.
Figure 5:
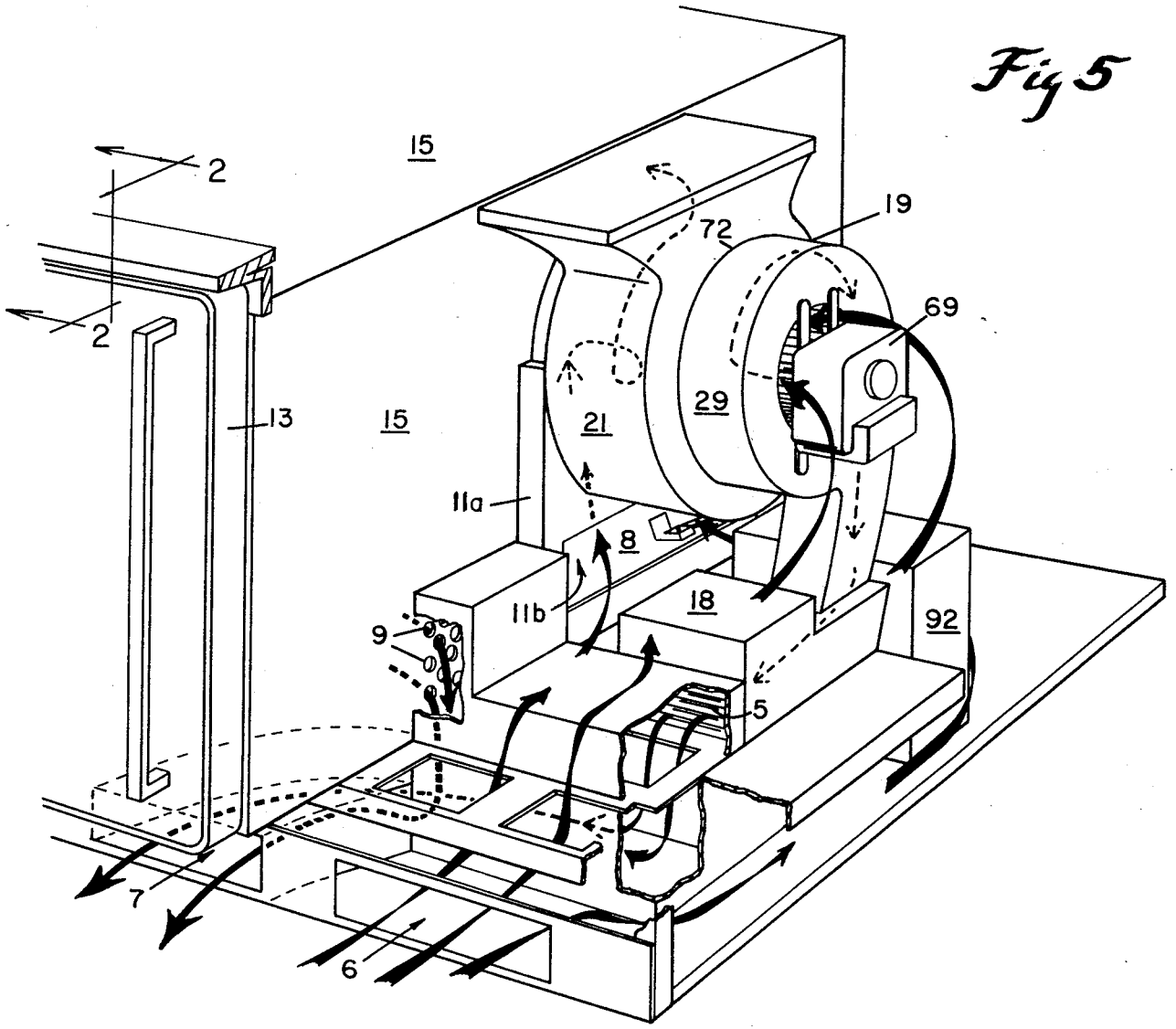
FIG. 5 is an elevated front perspective view of the oven of FIGS. 1 and 3 with the outer cover removed to illustrate the air circulation path outside of the oven cavity to cool the electrical component compartment area when the diverter is closed as more fully shown in FIGS. 2, 3, and 4.

Closing "LOW" temperature switch 48 effectively removes heater 17 from the circuit and activates vent solenoid 86 to close air flow diverter 8 regardless of the selection of the cooking mode of controls 34. Thus, closing "LOW" temperature switch 48 creates a second air circulation path. Diverter 8 is shown closed in FIG. 2, and when closed, prevents air in cavity 12 from being drawn into duct **11*a* and into blower wheel 21. In this second mode of air circulation as shown in FIGS. 3, 4 and 5, air is drawn from the electrical component compartment area including power transformer 92, into duct 11*a* through the opening 11*b* created by the closing of diverter 8. From there it follows the same path to the oven cavity 12 as before. In this second air flow mode, however, the cavity air is forced out openings 9 since duct 11*a* is blocked by diverter 8. From there the cavity air exits from the front of the oven through exhaust vent 7 as shown in FIG. 3**.

In the mode of operation with either "COMBINATION" button 40 or "MICROWAVE" button 42 together with "LOW" temperature button 48, the oven operates as a food dehydrator. The air to be circulated is warmed by the heat generated by the power transformer 92 and related components in the electrical component compartment area. It has been found that air heated in this manner reaches temperatures of 100° to 150° F., and very effectively removes the moisture from food, particularly fruits and vegetables, to provide a dehydrated food product that is naturally preserved without the need for chemical preservatives, additives, freezing, canning, blanching, sterilizing or other further food processing. When this heated air is combined with microwave energy, as is done when "COMBINATION" button 40 or "MICROWAVE" button 42 is pushed, such combined heating effects produce a superior, dehydrated food product faster then would otherwise be obtained from merely hot air-drying. For example, one-eighth to one-fourth inch thick, peeled Red Rome apple slices were dehydrated with power level controls 32 set at 10% microwave power in one-fourth the time typically required by conventional food dehydrators and were subsequently rehydrated with good results. Similar or even greater savings have been achieved with chopped onions, peeled tomato slices, and other fruits and vegetables.

In either of the air flow modes shown in FIG. 1 or FIG. 3, magnetron 18 and motor 69 are cooled by the flow of air through the second blower wheel 29 that is powered by motor 69 and shown in FIGS. 4 and 5. The air is drawn into the oven 10 through opening 6, passes through the electrical component compartment including transformer 92, and enters blower wheel 29. From there it is forced past cooling fins 5 for magnetron 18. If the diverter 8 is open (air flow mode of FIG. 1) the air is exhausted from the oven through vent 7. In the air flow mode of FIG. 3 provided by closing of diverter 8, some of the air (now warmed by passing through the electrical component compartment) is recirculated into the cavity 12 by being drawn into duct 11*a* by blower wheel 21. The air in the cavity 12 is diverted out opening 9 where it mixes with the air off the cooling fins 5 of magnetron 18 before exiting through front vent 7. By mixing the cavity air that may have been heated by a previous cooking step with the relatively cooler air from the magnetron before exhausting it from the oven 10, the exhausted air temperature is always kept within acceptable temperature limits.

By pressing "CONVECTION" button 38, oven 10 operates only as a forced air, hot air oven. Closing of contacts F and G of controls 34 disables triac triggering circuitry 88 as already described to provide only thermal energy to cavity 12. The temperature of that energy is, of course, determined by temperature level controls 36. The second set of contacts H and J closed by the depression of button 38 powers convection light 39, also shown on FIG. 7. In the convection mode of operation, if either the "MEDIUM" or "HIGH" temperature buttons 46 or 44 is depressed, air is circulated through cavity 12 by blower wheel 21 in the manner illustrated in FIG. 1 and described earlier. If "LOW" temperature button 48 is depressed, heater 17 is deactivated and vent solenoid 86 is activated to close diverter 8 and cause the air to flow through the path of FIG. 3 as previously described. In this mode, heat to the cavity 12 is provided only by the heat from the electrical component compartment and residual heat from heater 17.

By pressing "MICROWAVE" button 42, rather than "CONVECTION" button 38 or "COMBINATION" button 40, the oven 10 operates as a microwave oven alone with the air circulation always being that shown in FIGS. 3, 4 and 5 regardless of the selection of the temperature buttons 44, 46 and 48 of controls 36. These convection temperature controls 36 are rendered ineffective in the MICROWAVE cooking mode by the opening of contacts F and G of "CONVECTION" button 38 when "MICROWAVE" button 42 is pressed. Contacts D and E of switch 42 activate solenoid 86 to close diverter 8 (FIG. 2) and energize "microwave" light 43 when switch 49 is closed and switch 48 is open. Simultaneously, ganged contacts I and J provide power to mode stirrer motor 87.

Make-up air for the air circulation path illustrated in FIG. 1 may be provided through openings 9. It may be drawn into the cavity 12 by the rotation of wheel 21 or it may be forced in by wheel 29 depending upon the exact location of the openings 9 relative to blower wheels 21 and 29, the amount of air moved by wheels 21 and 29, respectively, and a host of other design criteria knowledgeable to one skilled in the art. The result is a slightly below or a slightly above atmospheric pressure inside the cavity 12. A slightly positive pressure may be preferable in that the resultant air turbulence will tend to more randomly distribute the air in the cavity 12 and result in more even heating of the food 27.

Blower 29 and blower 21 together form dual-end blower 19. They are single inlet, centrifugal fans mounted on a single shaft 71 extending from motor 69. They have a common wall 72 that prevents the direct exchange of air between them. Motor 69 is supported by bearing and bracket assembly 67. Bearing 67 is of conventional brass sleeve construction.

Mounting blowers 21 and 29 on a single shaft has the obvious advantage of eliminating the need for a second motor and shaft assembly. Additionally, however, the particular arrangement shown in FIGS. 4 and 5 has the unexpected result of protecting motor 69 and bearing 67 from the high temperatures that may be reached in blower 21 and thereby eliminating the need for special motor and bearing construction. By placing blower 29 between blower 21 and bearing 67, bearing 67 and motor 69 are protected from the heat in blower 21 when a cooking mode is utilizing heater 17 by a buffer of cool air flowing through blower 29 any time hot air is flowing through blower 21.

Figure 6:
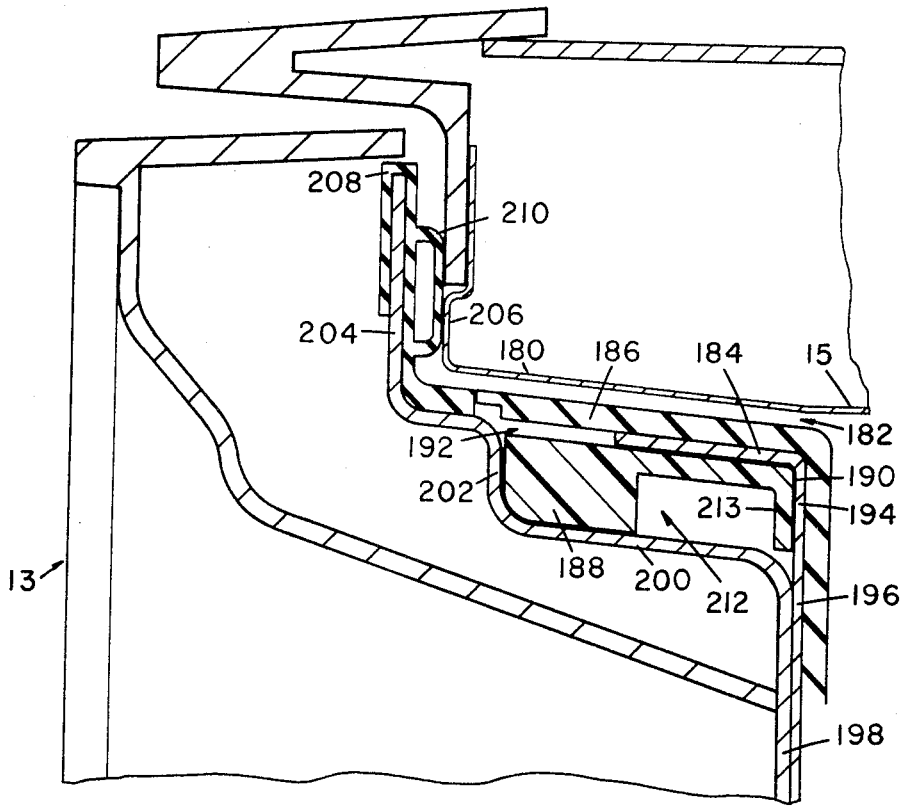
FIG. 6 is an enlarged cross-sectional view of the door of FIG. 5 along the line 2—2 illustrating an insertable, high-temperature door choke.

FIG. 6 illustrates the construction of the insertable, high-temperature door choke designed to withstand the heat and to simultaneously prevent the escape of thermal and microwave radiation. Referring to FIGS. 5 and 6, a microwave seal between the door 13 and the cavity walls 15 is formed by a structure comprising interior lip portion 180 of the oven cavity walls 15 which surround cavity 12 and a metal wall 184 of an input section 182 of a microwave seal. The metal wall 184 of the door 13 extends parallel to the wall 180 around the periphery of the oven and spaced therefrom by a sufficient distance to provide clearance when the door is shut, allowing for production tolerances and the resultant differences from oven to oven.

Attached to wall 184 is a solid dielectric 186 of suitable high-temperature characteristics such as Ultrx brand polyimide, manufactured by General Electric Company, Plastics Business Division, 100 Woodlawn Avenue, Pittsfield, Mass. 01201. Wall 184 is slotted as described in U.S. Pat. Nos. 3,767,884 and 4,137,441 to prevent microwave energy which attempts to enter the input section 182 at any angle from propagating in the structure. Aforementioned U.S. Pat. Nos. 3,767,884 and 4,137,441 are hereby incorporated by reference.

On the opposite side of the wall 184 is a solid dielectric 188 of suitable high-temperature characteristics such as polysulfone. Dielectric 188 fills a portion of a branch transmission line section 190 of the seal structure which is coupled to the input section 182 in a coupling region 192 beyond the end of the wall 184. The effective electrical length of the input section 182 from the cavity 12 to the coupling region 192 is preferably approximately one-quarter wave length of the frequency of magnetron 18.

Branch line 190 extends back along the slotted wall 184 which forms one wall of the branch line 190 to an end plate 194 to which wall 184 is a part. End plate 194 is electrically connected as, for example, by spot welding at point 196 to a second die formed conductive member 198 which has a portion 200 extending from its region of contact with end plates 194 substantially parallel to the wall 184 for a distance beyond the end thereof, with the region between wall 184 and wall portion 200 being filled with dielectric 188. An extension of wall portion 200 is formed into a second end plate 202 that is parallel to end plate 194, extends beyond the end of the wall 184, and becomes wall portion 204. Wall portion 204 is parallel to a front surface 206 of the cavity wall extension.

A layer of energy absorbing material 208 such as, for example, conductive silicone is attached to wall portion 204 and abuts dielectric 186. Material 208 is doubled into a tube-like portion 210 to press tightly against front surface 206 when the door 13 is closed.

A notch 212 is formed in the dielectric block 188 in the region of the end plate 194. A lip 213 may be left to prevent the location of dielectric 188 from shifting. By positioning the notch adjacent to the end plate 194, rather than adjacent to the coupling region 192, changes in the size of the notch 212 will not have a large tuning effect until a relatively large notch is created. For further discussion in this regard, see U.S. Pat. No. 4,137,441, already incorporated by reference.

Figure 10:
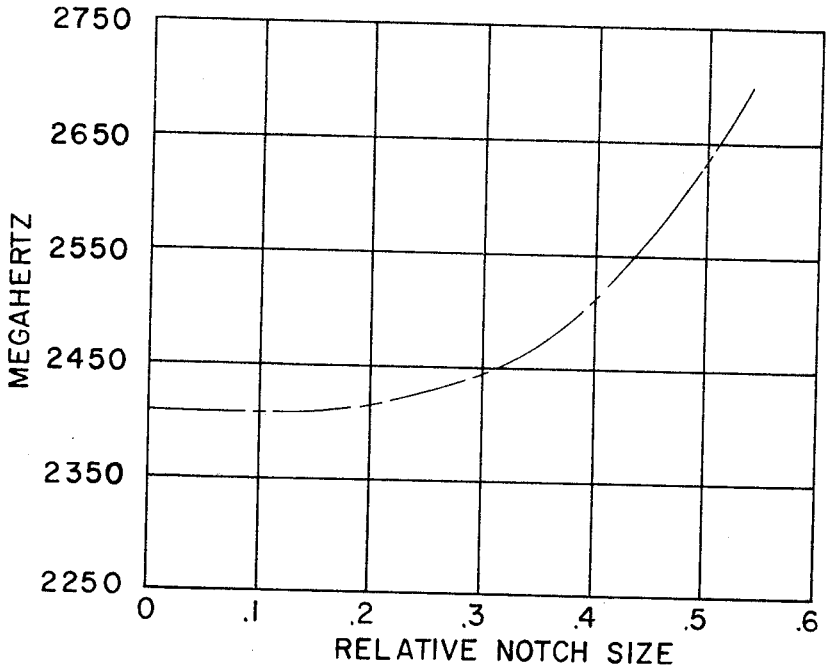
FIG. 10 is a graph of the microwave seal resonance frequency versus the relative size of the notch in the seal filler material shown in FIG. 6.

FIG. 10 illustrates the effect of the size of the notch on the microwave seal resonance frequency. The horizontal axis represents the length of the notch 212 as a portion of the total length of the dielectric 188. For example, 0.100 represents a notch one-tenth of the length of dielectric 188. The vertical axis represents the resonance frequency of the seal as a function of the notch length. It can be seen from FIG. 10 that three-tenths of the dielectric 188 must be removed to tune the seal to the desired frequency of 2450 MHz. This represents a considerable savings in the total amount of dielectric 188 required to tune the microwave seal to resonance. Further, because of the relatively flat slope of FIG. 10 up to the desired frequency of 2450 MHz, the dielectric 188 can be notched by conventional factory production techniques without the need for special measuring devices. As noted before, the size of the notch 212 is not as critical in this portion of the dielectric 188.

When a temperature probe is used in oven 10, its operation is controlled by circuitry 89, shown in FIG. 8. As noted earlier, the workings of circuitry 89 are detailed in U.S. Application Ser. Nos. 903,447 and 049,454 assigned to the same assignee as the present invention. When the temperature probe is plugged into a conventional plug and jack assembly, not shown, switches 68 and 65 close to power circuitry 89 in the fashion detailed in the patent applications incorporated by reference.

From the foregoing, it is apparent that all of the objectives of this invention have been achieved by the circuit shown and described. Hence, it is apparent that various modifications and changes may be made by those skilled in the art without departing from the spirit of the invention as expressed in the accompanying claims. Therefore, all matter shown and described is to be interpreted as illustrative and not in a limiting sense.

We claim:

1. An air flow system for a combination microwave and electric convection oven comprising:

a. a cabinet;

b. a plurality of wall members joined to divide the cabinet into an oven cavity and an electrical component compartment;

c. an electrical heater selectively associated with a wall member;

d. a first fan selectively associated with the oven cavity to generate a first movement of air in the oven cavity;

e. means for directing air from the first fan past the electrical heater before contacting food to be heated;

f. a second fan selectively associated with the electrical component compartment to generate a second movement of air in the electrical component compartment;

g. means for selectively diverting the first movement of air from the oven cavity outside the oven and simultaneously diverting the second movement of air inside the oven cavity, which means comprises:

(1) a conduit coupled to the first fan and selectively associated with the oven cavity whereby air from the oven cavity moves down the conduit and enters the first fan;

(2) a movable member associated with the conduit for selectively obstructing the flow of air in the conduit;

(3) means for exhausting the air in the oven cavity outside the oven; and (4) a portion of the conduit having an aperture therein that is exposed to the electrical component compartment with the movable member obstructs the flow of air in the conduit thereby replacing the exhausted cavity air with air from the electrical component compartment; and h. means for interconnecting the first fan and the second fan so that both fans are actuated simultaneously from a single motor.

2. The air flow system as recited in claim 1 wherein the air directing means comprises a duct coupled to the first fan and selectively associated with the oven cavity and having a plurality of apertures therein at a distance from the first fan whereby air from the first fan moves down the duct and enters the oven cavity through the apertures.

3. The air flow system as recited in claim 1 or 2 further comprising electromechanical means for actuating the movable member.

4. The air flow system as recited in claim 3 wherein the actuating means comprises:

a. a user-operated switch; and b. a solenoid electrically connected through the switch and selectively associated with the movable member to move the member in response to operation of the switch.

5. The air flow system as recited in claim 4 wherein the fan interconnecting means comprises a single shaft rotatably connected to the motor and connected to the fans to rotate the fans simultaneously when the motor is energized.

6. The air flow system as recited in claim 5 wherein the second fan is positioned between the first fan and the motor to act as a thermal barrier.

7. The air flow system as recited in claim 6 wherein air entering the second fan is drawn past the motor before entering the second fan to cool the motor.

8. An air flow system for a combination microwave and electric convection oven comprising:

a. a cabinet;

b. a plurality of wall members joined to divide the cabinet into an oven cavity and an electrical component compartment;

c. an electrical heater selectively associated with a wall member;

d. a first fan selectively associated with the oven cavity to generate a first movement of air in the oven cavity;

e. a duct coupled to the first fan and selectively associated with the oven cavity and having a plurality of apertures therein at a distance from the first fan whereby air from the first fan moves down the duct and enters the oven cavity through the apertures and past the electrical heater before contacting food to be heated;

f. a second fan selectively associated with the electrical component compartment to generate a second movement of air in the electrical component compartment;

g. means interconnecting the first fan and the second fan to operate both fans from a single motor so that the second fan acts as a thermal barrier between the first fan and the motor, the air being drawn into the second fan past the motor to cool the motor before entering the second fan; and h. means for selectively diverting the first movement of air outside the oven and simultaneously diverting the second movement of air inside the cavity, which means comprises:

(1) a conduit coupled to the first fan and selectively associated with the oven cavity whereby air from the oven cavity moves down the conduit and enters the first fan;

(2) a movable member associated with the conduit for selectively obstructing the flow of air in the conduit;

(3) means for exhausting the air in the oven cavity outside the oven; and (4) a portion of the conduit having an aperture therein that is exposed to the electrical component compartment when the movable member obstructs the flow of air in the conduit thereby replacing the exhausted cavity air with air from the electrical component compartment.

9. The air flow system as recited in claim 8 further comprising electromechanical means for actuating the movable member.

10. The air flow system as recited in claim 9 wherein the actuating means comprises:

a. a user-operated switch; and b. a solenoid electrically connected through the switch and selectively associated with the movable member to move the member in response to operation of the switch.

* * * * *